US007198089B2

(12) United States Patent
Hsu

(10) Patent No.: US 7,198,089 B2
(45) Date of Patent: Apr. 3, 2007

(54) PULL CORD OPERATION MECHANISM FOR BLINDS

(75) Inventor: Ben Hsu, Changhua Hsien (TW)

(73) Assignee: Cheng Feng Blinds Ind. Co., Ltd., Changhua Hsien (TW)

( * ) Notice: Subject to any disclaimer, the term of this patent is extended or adjusted under 35 U.S.C. 154(b) by 183 days.

(21) Appl. No.: 10/933,352

(22) Filed: Sep. 3, 2004

(65) Prior Publication Data

US 2006/0027341 A1 Feb. 9, 2006

(30) Foreign Application Priority Data

Jul. 23, 2004 (CN) ..... 093211676

(51) Int. Cl.
*E06B 9/30* (2006.01)

(52) U.S. Cl. ..... 160/170

(58) Field of Classification Search ..... 160/176.1 R, 160/177 R, 178.2 R, 170, 168.1 R, 84.04, 160/84.06, 173 R
See application file for complete search history.

(56) References Cited

U.S. PATENT DOCUMENTS

| | | | | |
|---|---|---|---|---|
| 2,758,644 | A * | 8/1956 | Virlouvet | 160/170 |
| 4,088,171 | A * | 5/1978 | Schluep et al. | 160/170 |
| 4,522,244 | A * | 6/1985 | Brolin | 160/170 |
| 5,628,356 | A * | 5/1997 | Marocco | 160/170 |
| 6,948,544 | B2 * | 9/2005 | Nien | 160/170 |

* cited by examiner

*Primary Examiner*—David Purol
(74) *Attorney, Agent, or Firm*—Troxell Law Office, PLLC

(57) ABSTRACT

A pull cord operation mechanism for blinds includes a fixing mount having a pair of slide grooves and a pivoting groove concaved at the upper edge of left/right sidewalls and a central reinforcing plate thereon respectively for retaining left/right roller ends and a linking shaft of a control member thereby, and a base board with a rectangular through hole precisely defined by the adjacent reinforcing support plate and one sidewall thereof. The fixing mount also has a pair of C-shaped engaging slots with lower openings disposed at the reinforcing support plate and one sidewall thereof to be registered with a pivoting rod of a retaining member thereby. The control member has a pair of cord passages symmetrically disposed at one side of the left/right roller ends thereon, and a pair of limiting stop rings of larger diameters protruding at one corresponding side of the two cord passages thereof. At the other side of the right roller end thereof is disposed an annular and toothed adjusting area made up of a plurality of abutting facets and curved sliding facets, and a pull cord hole for a pull cord to be led there-through and fixed thereto. Both sides of the pivoting rod of the retaining member are respectively disposed a linking section with a retaining hook extending at the upper end thereof, and an actuation section tilting downwards in a proper angle with rectangular cord-passage holes disposed thereon. Thus, via the operation mechanism above, the pull cord is directly suspended downwards in a single line without being wound and doubled up so as to avoid the danger of strangling children by accident for the safety of the household.

5 Claims, 6 Drawing Sheets

PULL CORD OPERATION MECHANISM FOR BLINDS

BACKGROUND OF THE INVENTION

The present invention is related to a pull cord operation mechanism for blinds, including a fixing mount, a control member, and a retaining member wherein the fixing mount has a pair of slide grooves and a pivoting groove concaved at the upper edge of left/right sidewalls and a central reinforcing plate thereon respectively for retaining left/right roller ends and a linking shaft of the control member thereby, and a pair of C-shaped engaging slots with lower openings disposed at the reinforcing support plate and one sidewall thereon to be registered with a pivoting rod of the retaining member; whereby, the retaining member and the control member cooperatively work with the individual actuation of a pull cord to generate a synchronic movement of linkage ropes or linking rope ladders of a blind body in a reverse direction so as to collect or expand the blind body thereby. And the pull cord is directly suspended downwards in a single line without being doubled up so as to avoid the danger of strangling children by accident for the safety of the household.

A conventional pull cord operation mechanism for blinds includes worm gear units adapted at both ends of an upper beam of a blind body to cooperatively work with a pull cord in operation. When the blind body is collected up, the pull cord, wound and doubled up, is suspended downwards for a certain length outside the blind body thereof. Children playing around the gathered-up blind body can easily get caught by the suspending pull cord. In case the pull cord gets detached from the clamping location of the worm gear units, the withdrawing pull cord might hurt or even strangle the children got caught in them. Thus, the conventional pull cord operation mechanism for blinds poses a potential danger and is quite unsafe to children in the family.

SUMMARY OF THE PRESENT INVENTION

It is, therefore, the primary purpose of the present invention to provide a pull cord operation mechanism for blinds, including a fixing mount, a control member, and a retaining member wherein the retaining member and the control member cooperatively work with the individual actuation of a pull cord to generate a synchronic movement of linkage ropes or linking rope ladders of a blind body in a reverse direction so as to collect or expand the blind body thereby. And the pull cord thereof is directly suspended downwards in a single line without being wound and doubled up so as to avoid the danger of strangling children by accident for the safety of the household.

DETAILED DESCRIPTION OF THE PREFERRED EMBODIMENTS

Figure 1:
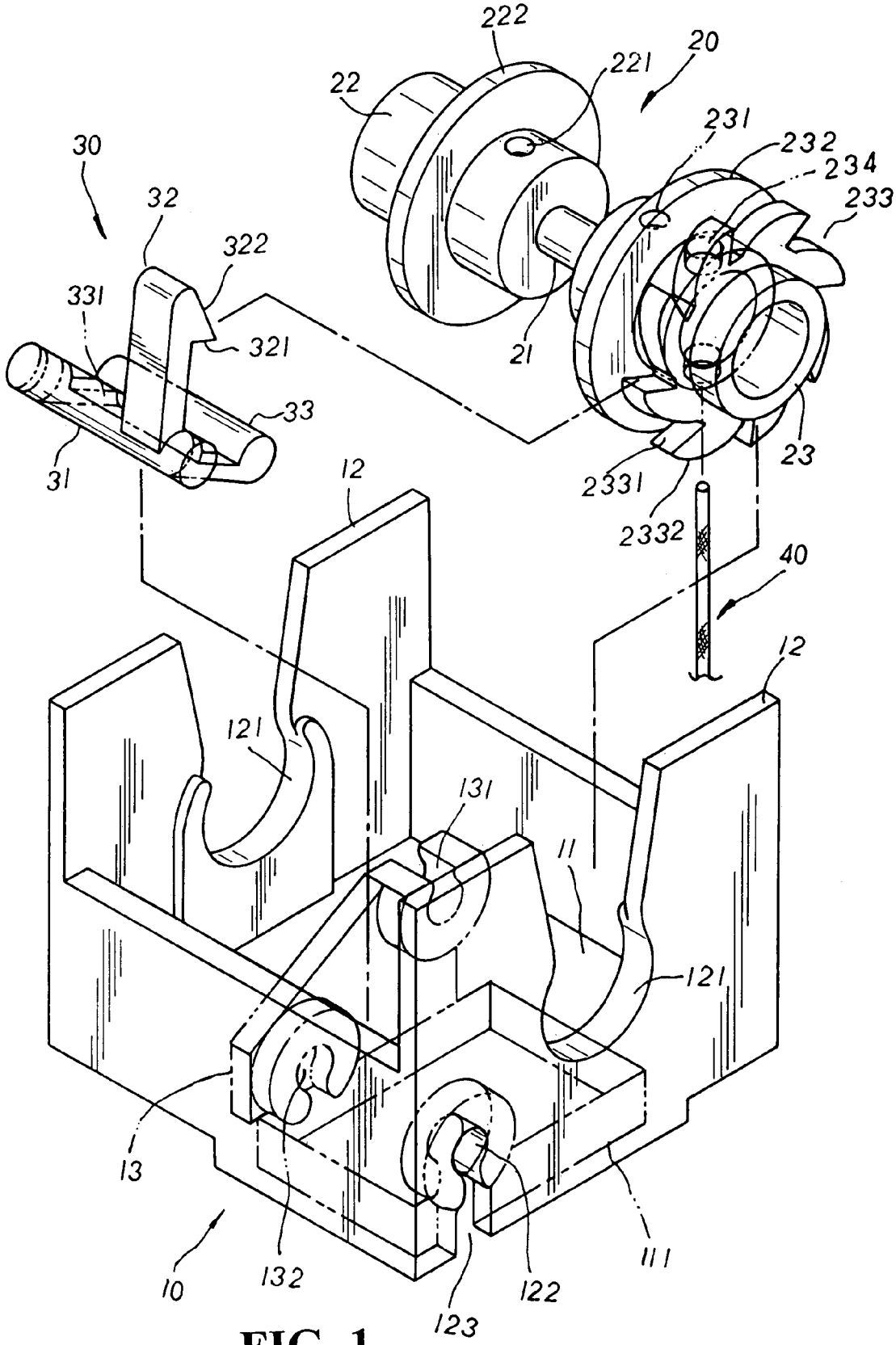
FIG. 1 is a perspective exploded view of the present invention.

Please refer to FIG. 1. The present invention is related to a pull cord operation mechanism for Venetian blinds, including a fixing mount 10, a control member 20, and a retaining member 30 wherein the fixing mount 10 is made up of a base board 11, a sidewall 12 extending at both left/right sides of the base board 11 thereon respectively, an arch and opening slide groove 121 concaved downwards at the upper edge of each sidewall 12 thereof, and a reinforcing support plate 13 protruding upwards in the middle of the base board 11 thereon. At the upper edge of the reinforcing support plate 13 is concaved a C-shaped pivoting groove 131 with an upper opening and concentrically aligned with the slide grooves 121 of the left/right sidewalls 12 thereof, and at one side of the base board 11 thereof is provided with a rectangular through hole 111 precisely defined by the adjacent reinforcing support plate 13 and the right sidewall 12 thereof A pair of C-shaped engaging slots 132, 122 with lower openings defined thereon is symmetrically disposed at the reinforcing support plate 13 and the right sidewall 12 thereon, precisely locating above both adjacent sides of the through hole 111 thereon, and a guide recess 123 is extending downwards under the engaging slot 122 of the sidewall 12 thereon in communication with the through hole 111 thereof. The control member 20 is made up of an annular hollow tube, having a linking shaft 21 of a smaller diameter disposed at the middle section thereof, and a pair of roller ends 22, 23 of larger diameters symmetrically attached at both left/right sides of the linking shaft 21 thereof. At one side of the left/right roller ends 22, 23 is respectively disposed a cord passage 221, 231 communicating the upper and lower peripheries of the roller ends 22, 23 thereby, and at the corresponding side of both cord passages 221, 231 thereof is respectively protruding a limiting stop ring 222, 232 of a larger diameter. At the other side of the right roller end 23 is disposed a milled-tooth adjusting area 233 made up of a plurality of abutting facets 2331 and curved sliding facets 2332, and a pull cord hole 234 disposed between the adjusting area 233 and the limiting stop ring 232 thereof for a pull cord 40 to be led there-through and securely fixed thereto. The retaining member 30 is made up of an annular pivoting rod 31, at one side of which is disposed a linking section 32 with a retaining hook 321 extending at the upper end thereof and a guide slope 322 cut at the upper edge of the retaining hook 321 thereon. At the other side of the annular pivoting rod 31 thereof is provided with an actuation section 33 tilting downwards in a proper angle with rectangular cord-passage holes 331 disposed thereon.

Figure 2:
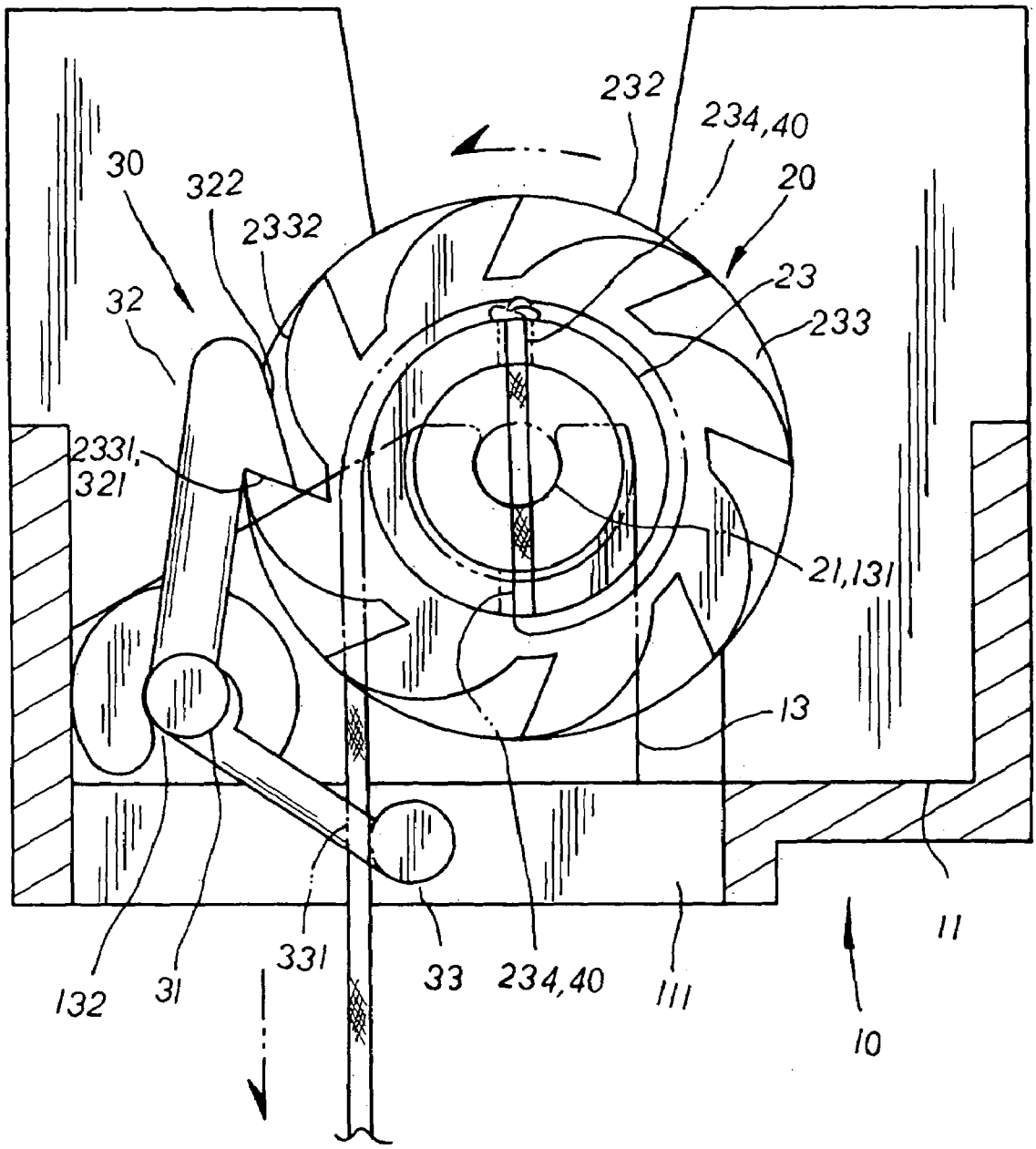
FIG. 2 is a diagram showing the operation mechanism of the present invention to gather up a blind body.
Figure 3:
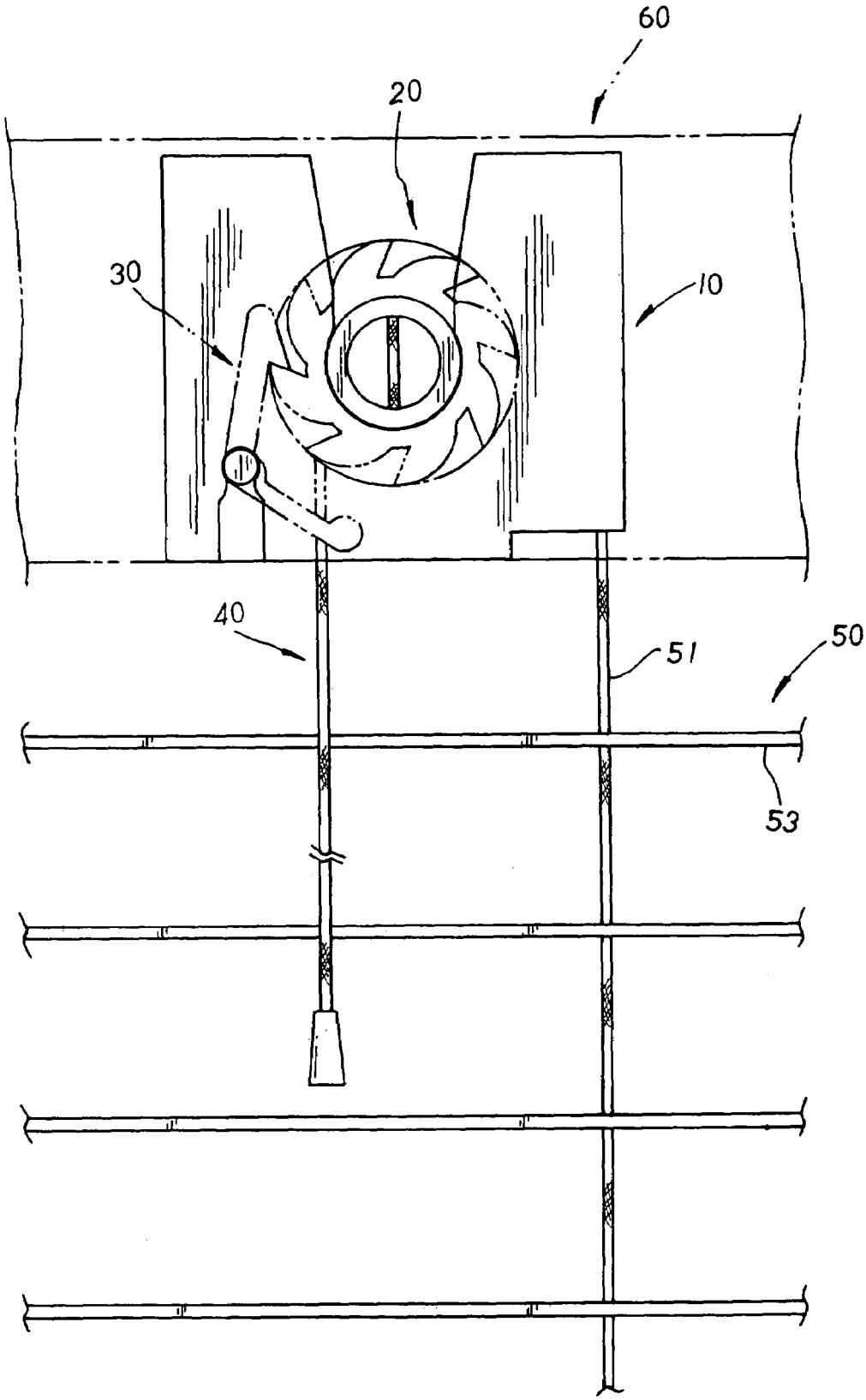
FIG. 3 is a diagram showing the present invention in cooperative working with a linkage rope in practical use.
Figure 4:
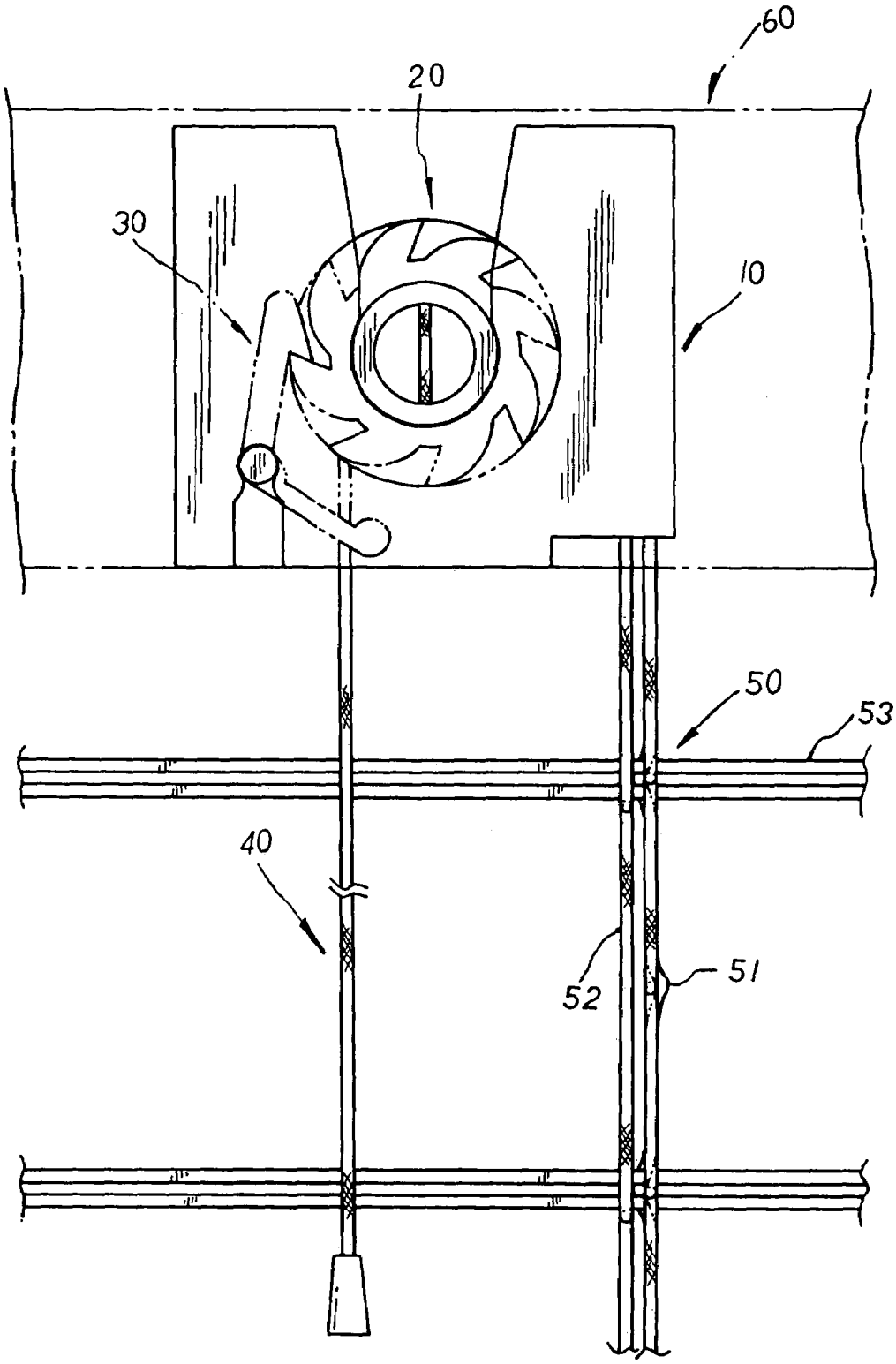
FIG. 4 is a diagram showing the present invention in cooperative working with a rope ladder in practical use.

Please refer to FIGS. 2 to 4 inclusive. In assembly, the retaining member 30 is led upwards from the underside of the fixing mount 10 to pass through the guide recess 121 communicating with the through hole 111 thereof till the pivoting rod 31 thereof is pivotally registered with the left/right engaging slots 132, 122 thereof. The left/right roller ends 22, 23 of the control member 20 are correspondingly forced into the slide grooves 121 of the sidewalls 12 respectively for mutual engagement therewith, and the linking shaft 21 is precisely received at the pivoting groove 131 of the reinforcing support plate 13, separating the left/right roller ends 22, 23, at both adjacent sides of the reinforcing support plate 13 thereof. Meanwhile, the actuation section 33 of the retaining member 30, limited at the through hole 111 therein, is affected by the gravity force to descend, which in turn will activate the pivoting rod 31 to rotate downwards along the engaging slots 132, 122 thereof and the retaining hook 321 thereof to abut precisely against the abutting facet 2331 of the adjusting area 233 thereof for secure location of the control member 20 thereby. Linkage ropes 51 of a blind body 50 like Venetian blinds that are led through a plurality of slats 53 to move upwards or downwards the slats 53 in the folding/unfolding operation of the blind body 50 as shown in FIG. 3, or linking rope ladders 52 that are applied to pile up the slats 53 of the blind body 50 in pairs as shown in FIG. 4, are respectively guided through the cord passages 221, 231 of the left/right roller ends 22, 23 and securely attached thereto at the control member 20 thereof to unfold the blind body 50 in fully expanded status. A pull cord 40, led upwards via the through hole 111 to pass through the pull cord hole 234 and fixedly attached thereto, is wound through the right roller end 23 defined by the limiting stop ring 232 and the adjusting area 233 thereof and suspending downwards for a proper length at one side of an upper beam 60 to complete the assembly of the present invention.

Figure 5:
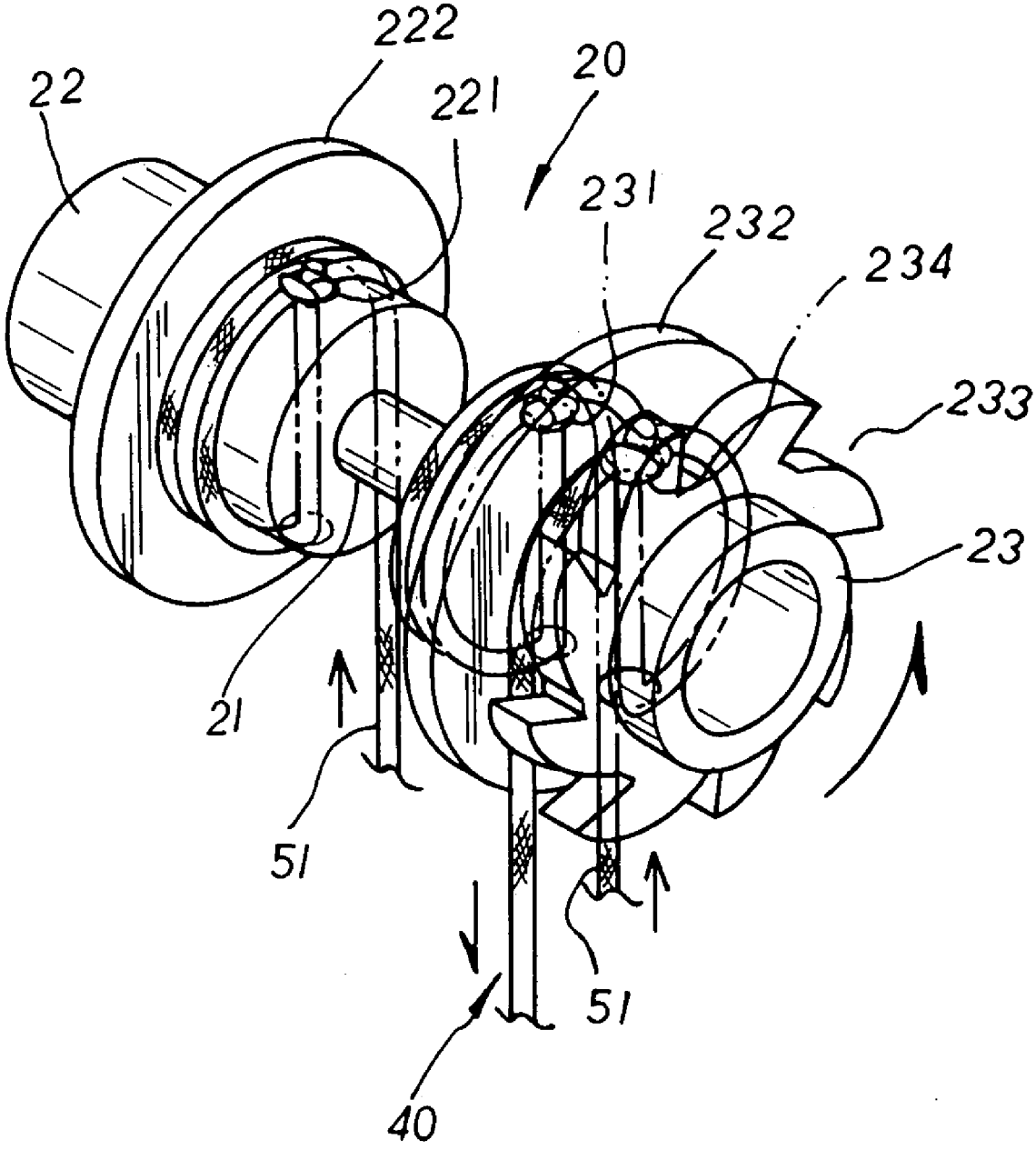
FIG. 5 is a diagram showing the mechanism of a pull cord of the present invention working with linkage ropes or linking rope ladder in the gathering-up operation of the blind body thereof.

To collect the blind body 50 thereof as shown in FIG. 2, the pull cord 40 is simply drawn downwards to actuate the rotation of the left/right roller ends 22, 23 and the linking shaft 21 of the control member 20 along the slide grooves 121 and the pivoting groove 131 respectively in the same direction therewith. And the adjusting area 23 is simultaneously rotated along with the actuated control member 20 accordingly, permitting the curved sliding facet 2332 thereof to push aside the guide slope 322 of the retaining member 30 thereof and the abutting facet 2331 thereof to detach from the retaining hook 321 thereof. Thus, the control member 20 can be freely rotated to release the pull cord 40 wound at the right roller end 23 thereon. And, due to the pulling force generated by the ongoing rotation of the control member 20 thereof, the linkage ropes 51 or the linking rope ladders 52 are respectively wound through and collected at the left/right roller ends 22, 23 thereon so as to gather up the blind body 50 thereby. The linkage ropes 51 or the linking rope ladders 52, individually separated by the reinforcing support plate 13 and the limiting stop rings 222, 232 thereof, are synchronically actuated by the control member 20 to rotate in a reverse direction relative to the pull cord 40 thereof, facilitating the collection of the linkage ropes 51 or the linking rope ladders 52 as well as the release of the pull cord 40 thereof so as to fold up the blind body 50 in an easy and smooth manner as shown in FIG. 5. When the force applied onto the pull cord 40 is removed to stop the rotation movement of the adjusting area 233 of the control member 20 thereof, the actuation section 33 of the retaining member 30 will descend to bring downwards the linking section 32 accordingly with the retaining hook 321 mutually abutting against the abutting facet 2331 again so as to relocate the blind body 50 precisely at a collected position as desired.

Figure 6:
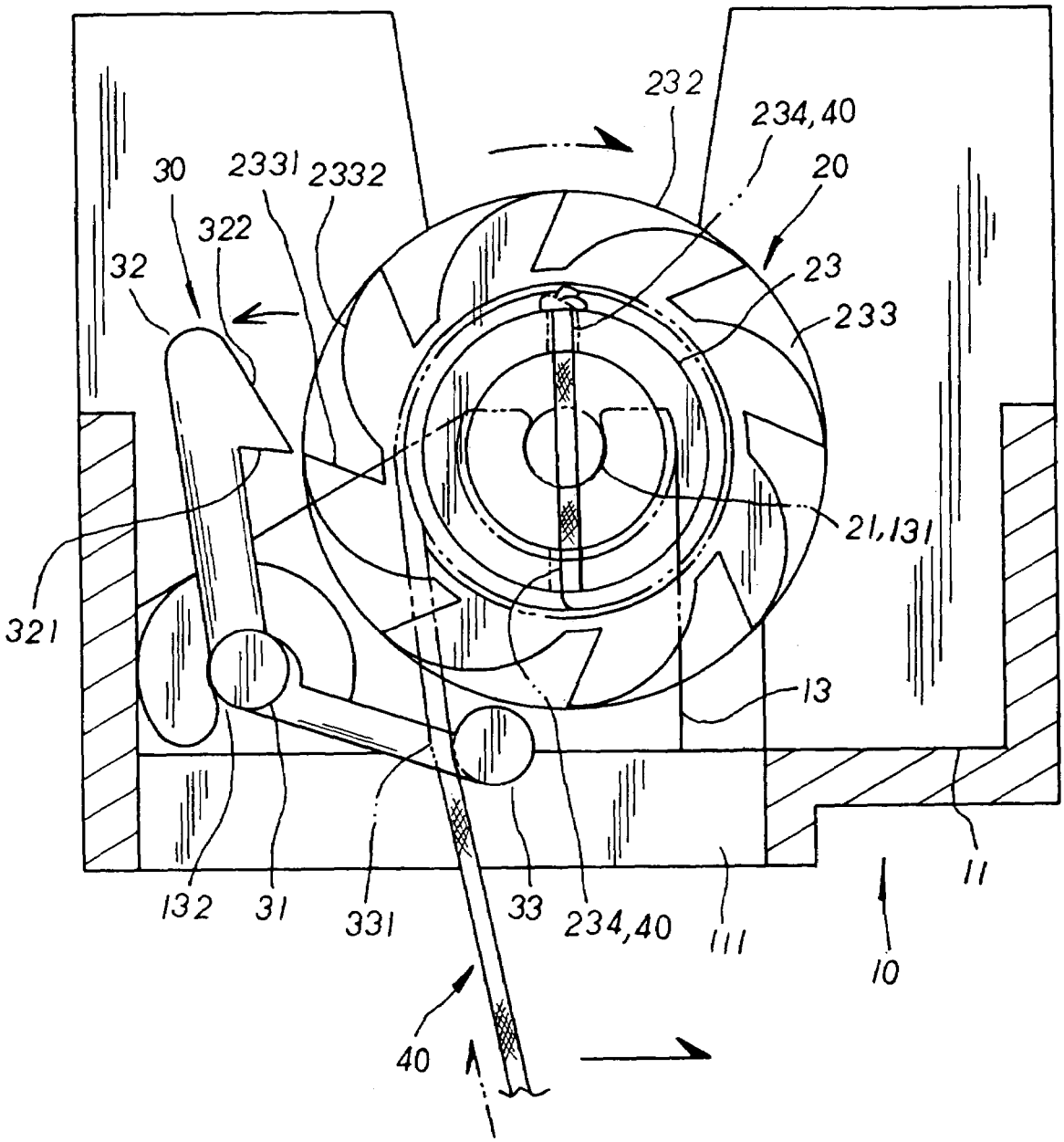
FIG. 6 is a diagram showing the mechanism of the present invention to expand the blind body thereof.

Please refer to FIG. 6. To expand the blind body 50 downwards, the pull cord 40 is drawn to one side at the cord-passage hole 331 of the retaining member 30 therein till pushing at the actuation area 33 for which to pivotally rotated upwards so as to detach the retaining hook 321 of the linking section 32 from the abutting facet 2331 of the control member 20 thereby. When the pull cord 40 is persistently drawn sideways to abut against the actuation area 33 of the retaining member 30, the linkage ropes 51 or linking rope ladders 52 are properly released to generate a down-pulling force by the blind body 50 affected by the gravity force thereof. The linkage ropes 51 or linking rope ladders 52 respectively collected at the control member 20 and pulled by the gravity force of the descending the blind body 50 will actuate the rotation of the control member 20, which will synchronically unwind the linkage ropes 51 or the linking rope ladders 52 to unfold the blind body 50 thereby. Meanwhile, the pull cord 40 is precisely wound and collected at the roller end 23 thereon along with the rotation of the control member 20 thereof. And the pull cord 40 is simply released to abut the retaining hook 321 against the abutting facet 2331 thereof for relocation of the control member 20 thereby. Thus, the retaining member 30 and the control member 20 cooperatively work with the individual actuation of the pull cord 40 to generate a synchronic movement of the linkage ropes 51 or linking rope ladders 52 in a reverse direction so as to collect or expand the blind body 40 thereby. And the pull cord 50 is directly suspended downwards in a single line without being wound and doubled up so as to avoid the danger of strangling children by accident for the safety of the household.

What is claimed is:

1. A pull cord operation mechanism for blinds comprising:

a) a fixing mount having:

i) a base board;

ii) two side walls, one of the two side walls is located on each of two opposing sides of the base board;

iii) a slide groove located in a top of each of the two side walls;

iv) a reinforcing support plate protruding upwardly from a middle of the base board and having a C-shaped pivoting groove with an upper opening concentrically aligning with the slide groove of each of the two side walls;

v) a rectangular through hole located in the base board between the reinforcing support plate and a first side wall of the two side walls;

vi) two engaging slots located above the rectangular through hole, a first engaging slot of the two engaging slots is located in the reinforcing support plate, a second engaging slot of the two engaging slots is located in the first side wall; and vii) two guiding recesses, one of the two guiding recesses is located below each of the two engaging slots, one of the two engaging slots communicating with the rectangular through hole through each of the two guiding recesses;

b) a control member connected to the fixing mount and having:

i) a linking shaft; and ii) two roller ends located on opposing sides of the linking shaft, each of the two roller ends have a diameter larger than a diameter of the linking shaft, each of the two roller ends has a cord passage located through a first end thereof and a limiting stop ring located on one side of the cord passage of each of the two roller ends, a first roller end of the two roller ends has an adjusting area and a pull cord hole located on a second end thereof, the adjusting area including a plurality of abutting facets and curved sliding facets, a pull cord is inserted through the pull cord hole and secured to the first roller end; and c) a retaining member connected to the fixing mount and having:

i) an annular pivoting rod;

ii) a linking section having a first end located on a first end of the annular pivoting rod;

iii) a retaining hook located on a second end of the linking section and having a guide slope located on an upper edge thereof; and iv) an actuation section located on a second end of the annular pivoting rod, the actuation section tilting downwardly at a predetermined angle and having a plurality of cord passage holes located therein.

2. The pull cord operation mechanism according to claim 1, wherein the control member has an annular and hollow tubular shape.

3. The pull cord operation mechanism according to claim 1, wherein the adjusting area of the control member has a toothed shape.

4. The pull cord operation mechanism according to claim 1, wherein each of the plurality of cord passage holes of the actuation section of the retaining member have a rectangular shape.

5. The pull cord operation mechanism according to claim 1, wherein each of the two engaging slots of the fixing mount has a C-shape with a lower opening.

* * * * *